US012037724B2

(12) United States Patent
David

(10) Patent No.: US 12,037,724 B2
(45) Date of Patent: Jul. 16, 2024

(54) DYNAMIC ROPE

(71) Applicant: Steve David, Baltimore, MD (US)

(72) Inventor: Steve David, Baltimore, MD (US)

( * ) Notice: Subject to any disclaimer, the term of this patent is extended or adjusted under 35 U.S.C. 154(b) by 0 days.

(21) Appl. No.: 17/902,575

(22) Filed: Sep. 2, 2022

(65) Prior Publication Data

US 2024/0075333 A1 Mar. 7, 2024

(51) Int. Cl.

| | |
|---|---|
| ***D04C 1/12*** | (2006.01) |
| ***A63B 5/20*** | (2006.01) |
| ***A63B 21/055*** | (2006.01) |
| ***D04C 1/02*** | (2006.01) |

(52) U.S. Cl.

CPC ..... *D04C 1/12* (2013.01); *A63B 5/20* (2013.01); *A63B 21/0555* (2013.01); *D04C 1/02* (2013.01); *D10B 2331/00* (2013.01); *D10B 2401/061* (2013.01); *D10B 2507/00* (2013.01)

(58) Field of Classification Search

CPC .... D04C 1/02; D04C 1/12; A63B 5/20; A63B 21/4035

See application file for complete search history.

(56) References Cited

U.S. PATENT DOCUMENTS

| | | | | |
|---|---|---|---|---|
| 5,533,947 | A * | 7/1996 | Tomlinson | A63B 5/20 482/81 |
| 5,842,956 | A | 12/1998 | Strachan | |
| 6,742,909 | B2 * | 6/2004 | Conti | D07B 1/148 362/108 |
| 7,628,743 | B1 * | 12/2009 | Flentye | A63B 21/0004 482/121 |
| 7,794,369 | B1 | 9/2010 | Rivera, III | |
| 7,827,895 | B2 | 11/2010 | Wang | |
| 9,050,484 | B2 * | 6/2015 | Flentye | A63B 21/4035 |
| 9,320,932 | B2 | 4/2016 | Newman | |
| 10,561,879 | B2 | 2/2020 | Huang | |
| 11,278,758 | B2 | 3/2022 | Buikema et al. | |
| 2005/0260902 | A1 * | 11/2005 | Geier | B63H 19/02 441/74 |

FOREIGN PATENT DOCUMENTS

| | | | | |
|---|---|---|---|---|
| DE | 202015000274 | U1 * | 7/2015 | A63B 21/0442 |

* cited by examiner

*Primary Examiner* — Shaun R Hurley

(74) *Attorney, Agent, or Firm* — Larry J. Guffey, Esq.; Oliver & Grimsley, LLC

(57) ABSTRACT

A method of fabricating a rope that can serve as both a resistance band, jump or rolling rope includes the steps of: (a) braiding a plurality of elastic tubes into a braided rope which has two ends, (b) forming a loop at each of these ends, (c) securing each of these loops to this braided rope with a knot or a zip tie, (d) attaching a handle to this braided rope proximate each of these ends, (e) wherein these elastic tubes are: (i) fabricated from materials in the group including a latex rubber and a non-latex, synthetic rubber, (ii) selected from the group including those having differing diameters, wall thicknesses, and weights per linear foot, and (iii) selected to makeup a specific, braided rope having a specified elasticity and weight per linear foot.

20 Claims, 3 Drawing Sheets

DYNAMIC ROPE

BACKGROUND OF THE INVENTION

1. Field of the Invention

This invention relates to a training apparatus and physical therapy rehabilitation. More particularly, the present invention relates to training and exercising ropes.

2. Description of the Related Art

The use of exercise ropes or resistance bands in physical fitness and physical therapy applications is well known in the art. Some of the exercise ropes and bands currently being used for physical fitness and physical therapy are called "jump or rolling ropes" and "resistance or elastic bands." They can be used for many differing types of conditioning, e.g., strength training, anaerobic, and aerobic exercise, neuromuscular re-education and coordination.

A "jump rope" is often used for aerobic exercise and a cardiovascular workout. Generally, a jump rope is merely a rope or cord suspended from a handle at each end. Its length may vary and is dictated by the height of its user who needs its length to be such that the user can hold one end in each hand, with the hands near the body and about at chest level, and have the middle of the rope just touch the ground beneath the user. One then swings the rope over one's head and beneath one's feet while jumping or skipping over it.

A "rolling rope" will often be very similar in design and construction to that of a jump rope. However, it is used very differently than a jump rope. Instead of swinging the portion of it that extends from its handles around an axis of revolution that passes between one's hands and jumping over a middle portion of it as it passes below one's feet, a user holds an end in either hand (or holds both ends in a single hand) and moves the handles so as to cause the rope to swing and move around one's body so that the rope moves in different planes and patterns that don't require the user to jump over it. Using a rope in this manner is said to improve one's physical capabilities and the sense of coordination and rhythm in one's hands, arms and upper body.

An "elastic or resistance band" is a popular stretching or strength training tool. They can be used in many, different ways. For example, one end of an elastic band can be held under a user's feet or fastened to a wall, and the other end of it pulled and relaxed repeatedly by the user's hand; thereby allowing a user to perform various arm exercises.

There have been many prior attempts to optimize the construction and performance of such training or exercise ropes and bands. These include: U.S. Pat. No. 11,278,758 to Buikema et. al., U.S. Pat. No. 10,561,879 to Huang, U.S. Pat. No. 9,320,932 to Newman, U.S. Pat. No. 7,827,895 to Wang, U.S. Pat. No. 7,794,369 to Rivera, and U.S. Pat. No. 5,842,956 to Strachan.

The present invention seeks to continue the optimization of such ropes. In particular, the present invention provides a new type of dynamic rope that is elastic and can serve as both a jump/rolling rope and a resistance band. Because of its elasticity, it's additional movement when being used as a rolling rope is seen to enable this dynamic rope to apply greater forces on a user's musculoskeletal system, thereby providing its user with a more effective workout, than a conventional, non-elastic rolling rope of the same weight per unit length.

DESCRIPTION OF THE PREFERRED EMBODIMENT

Figure 1:
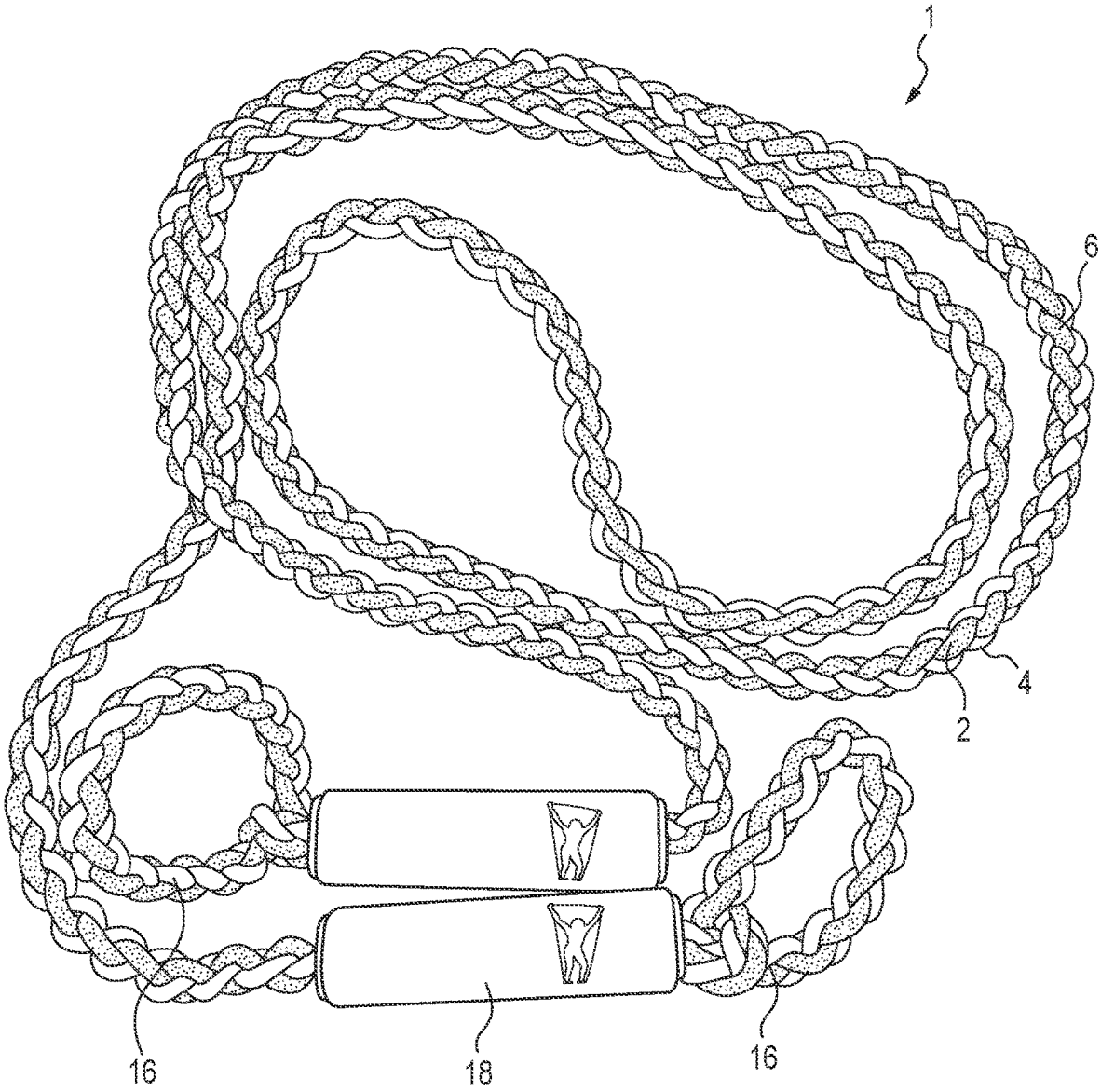
FIG. 1 is a from-above, perspective view of a preferred embodiment of the present invention when it has curled up upon itself.

Recognizing the need for further improvements to exercise ropes, the present invention provides a new type of dynamic rope that can serve as both a jump/rolling rope and a resistance band.

Various aspects, advantages, features and embodiments are included in the following description of exemplary examples thereof, which description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Because of the present invention or dynamic rope's elasticity, when it is being used as a rolling rope, it dynamically flexes and bends to distort itself into shapes that are not seen with a conventional, non-elastic rope. This phenomena enables a dynamic rope to apply greater forces on a user's musculoskeletal system (for the same amount of body movement) than a conventional, non-elastic rolling rope of the same weight per unit length. Consequently, a user is potentially provided with a more effective workout when using a dynamic rope as compared to using a conventional, non-elastic, rolling rope.

Additionally, also because of the dynamic rope's elasticity, it can be used as a resistance band. This dual purpose, exercise rope can therefore provide its user with more conditioning benefits than any other single exercise rope since it can be used to facilitate cardiovascular fitness, muscular strengthening, while also enhancing one's balance and coordination.

Figure 2:
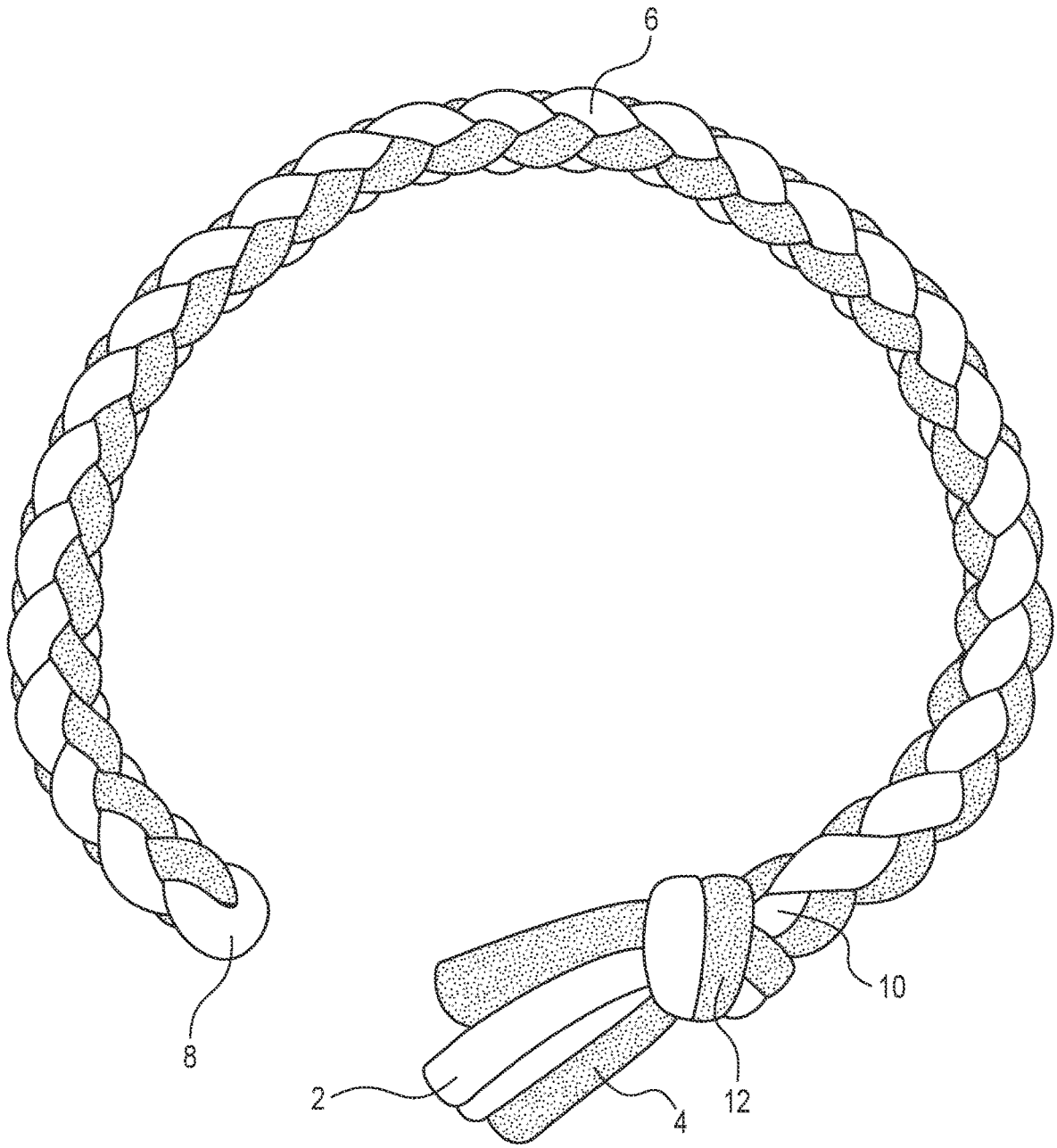
FIG. 2 is a from-above, perspective view of a braid that has been formed using a four-strand, braid method and which is suitable for use in constructing the present invention.

FIG. 1 is a from-above, perspective view of a preferred embodiment of the present invention (i.e., a dynamic rope) 1. It is preferably fabricated by braiding two, selected, elastic tubes 2, 4 (although a greater number of tubes can also be used) into a four-strand (or 6 or more stand) braid 6 which has two ends, a closed end 8 and a free end 10 at which the ends of the tubes are held together with a knot 12 or a zip tie or a similar binding means. See FIG. 2.

For detailed information on this manner of braiding, see: "Decorative Fusion Knots: A Step-by-Step Illustrated Guide to New and Unusual Ornamental Knots," by J. D. Lenzen and Barry Mault (2011).

Figure 3:
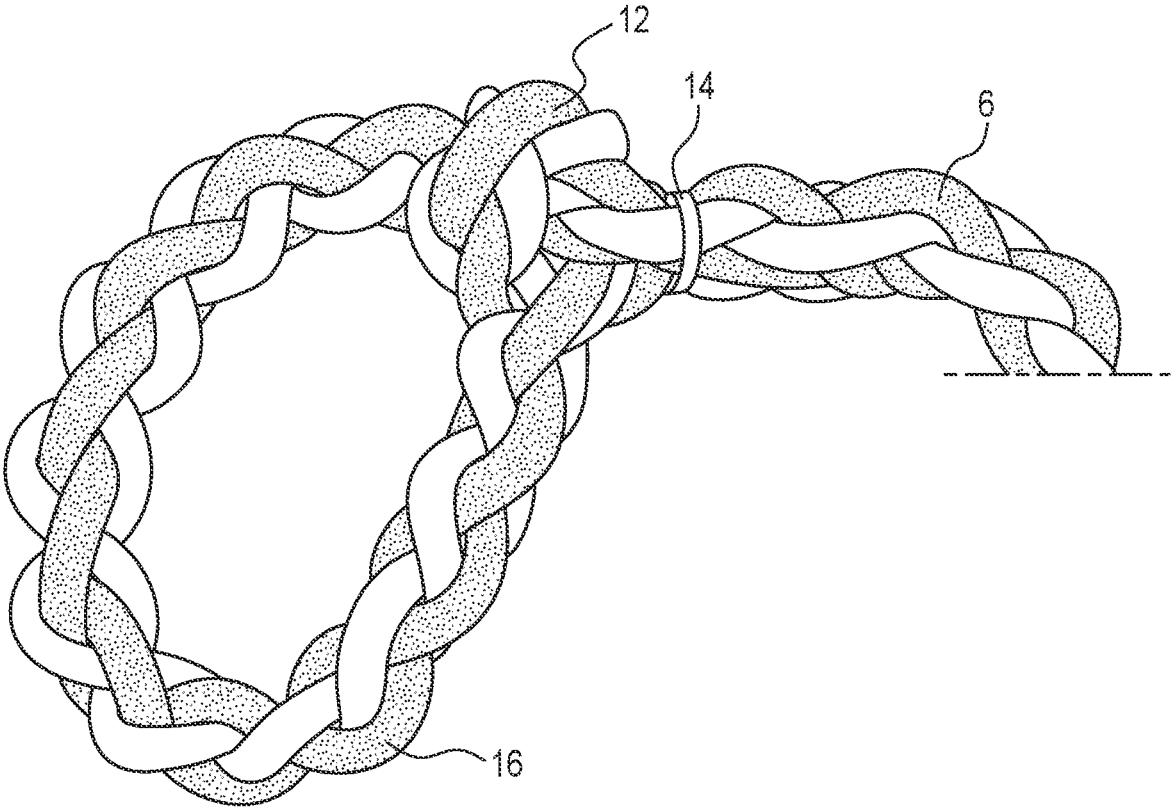
FIG. 3 is a from-above, perspective view of an end of the present invention in which a loop has been formed and before a handle has been added.

Once a braid 6 of a desired length is formed, a loop 16 is formed at either end by either using another knot 12 or zip tie 14 or both or a similar binding means. See FIG. 3. The purpose of the loops is to make it easier to perform specific exercises. In other situations, they can also be used as a backup handle for other exercises.

Tubular handles 18 are added to the braid and are situated proximate its' ends and just inside of the rope's loops, while the braid itself passes through the handles. They may be covered with a layer of softer material to make them easier to grip, while also minimizing the frictional loads that such handles can apply to a user's hands when the dynamic rope is being used for exercise.

The elastic tubes that make-up the dynamic rope are chosen so as to give a desired stiffness, elasticity, and weight per linear foot to the rope. Typical tube dimensions are in the range of: outer diameter=0.15-0.50 inches, wall thickness=0.03-0.10 inches. Typical tube weights per linear foot are in the range of 0.12-0.5 ounces per foot. Typical weights per linear foot of the finished braided rope are in the range of 0.25-2.0 ounces per foot. To easily distinguish between these possible braided ropes, color will often be added to the materials from which the tubes are fabricated so that the resulting, differing diameter tubes have different colors and the ropes are therefore often multi-colored.

Typical dynamic rope lengths, when it is to be used as a jump rope are rolling rope, are in the range of 6-10 feet. When larger elastic tubes (e.g., outer diameter=1-2 inches, wall thickness=0.4-0.7 inches) are used, the present invention can be configured in the form of a battle rope whose length would also be considerably longer (e.g., 25-60 feet). Typical weights per linear foot of such a braided battle rope are in the range of 4.0-20 ounces per foot.

Suitable elastic materials from which to form the rope's elastic tubes include latex rubber and non-latex, synthetic rubbers.

A method of fabricating the present invention, that can serve as both a resistance band, includes the steps of: (a) braiding a plurality of the above described, elastic tubes into a braided rope which has two ends, (b) forming a loop at each of these ends, (c) securing each of these loops to this braided rope with an attachment means, typically a knot or a zip tie, (d) attaching a handle to this braided rope proximate each of these ends, (e) wherein these elastic tubes are fabricated from materials in the group including a latex rubber and a non-latex synthetic rubber, (f) wherein these elastic tubes are selected from the group including those having differing diameters, wall thicknesses, and weights per linear foot, and (g) wherein the elastic tubes that are selected to makeup a specific, braided rope are chosen so as to provide this braided rope with a specified or desired elasticity and weight per linear foot.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereafter set forth in the claims to the invention.

I claim:

1. A braided rope that can serve as both a resistance band, jump or rolling rope, said braided rope comprising:

a plurality of selected, elastic tubes that are braided into said braided rope which has two ends, a loop at each end of said braided rope, an attachment means that secures said loop to said braided rope, a pair of handles-, one of which is attached proximate each end of said braided rope, wherein said elastic tubes are fabricated from the group of materials consisting of a latex rubber and a non-latex, synthetic rubber, wherein each of said plurality of selected elastic tubes having a diameter that is within a range of diameters, a wall thickness that is within a range of wall thicknesses-, and a weight per linear foot that is within a range of weights per linear foot, wherein said braided rope having a desired elasticity and weight per linear foot, wherein said desired elasticity and weight per linear foot of said braided rope are achieved by selecting: (a) the number of said plurality of selected elastic tubes to be used in said braiding, and (b) each of said number of said plurality of selected elastic tubes to be used in said braiding to have a required diameter from amongst said range of diameters and a required wall thickness from amongst said range of wall thickness, and wherein said range of diameters is 0.15-0.50 inches for an outer diameter.

2. The braided rope as recited in claim 1, wherein:

said range of wall thicknesses is 0.03-0.10 inches.

3. A method of fabricating a rope that can serve as both a resistance band, jump or rolling rope, said method comprising the steps of:

braiding a plurality of selected, elastic tubes into a braided rope which has two ends, forming a loop at each end of said braided rope, securing said loop to said braided rope with an attachment means, attaching a pair of handles to said braided rope and situating one of said pair of handles proximate each of said ends, wherein said elastic tubes are fabricated from the group of materials consisting of a latex rubber and a non-latex, synthetic rubber, wherein each of said plurality of selected elastic tubes having a diameter that is within a range of diameters, a wall thickness that is within a range of wall thicknesses, and a weight per linear foot that is within a range of weights per linear foot, wherein said braided rope having a desired elasticity and weight per linear foot, wherein said desired elasticity and weight per linear foot of said braided rope are achieved by selecting: (a) the number of said plurality of selected elastic tubes to be used in said braiding, and (b) each of said number of said plurality of selected elastic tubes to be used in said braiding to have a required diameter from amongst said range of diameters and a required wall thickness from amongst said range of wall thicknesses, and wherein said range of diameters is 0.15-0.50 inches for an outer diameter.

4. The method as recited in claim 3, wherein:

said braiding is accomplished using a four-strand braid.

5. The method as recited in claim 4, wherein:

said range of wall thicknesses is 0.03-0.10 inches.

6. The method as recited in claim 5, wherein:

said braided rope has a weight per linear foot that is in the range of 0.25-2.0 ounces per foot.

7. The method as recited in claim 6, wherein:

said braided rope has a length in the range of 6-10 feet.

8. The method as recited in claim 5, wherein:

said braided rope has a length in the range of 6-10 feet.

9. A method of fabricating a rope that can serve as both a resistance band, jump or rolling rope, said method comprising the steps of:

braiding a plurality of selected, elastic tubes into a braided rope which has two ends, forming a loop at each end of said braided rope, securing said loop to said braided rope with an attachment means, attaching a pair of handles to said braided rope and situating one of said pair of handles proximate each of said ends, wherein said elastic tubes are fabricated from the group of materials consisting of a latex rubber and a non-latex, synthetic rubber, wherein each of said plurality of selected elastic tubes having a diameter that is within a range of diameters, a wall thickness that is within a range of wall thicknesses, and a weight per linear foot that is within a range of weights per linear foot, wherein said braided rope having a desired elasticity and weight per linear foot, wherein said desired elasticity and weight per linear foot of said braided rope are achieved by selecting: (a) the number of said plurality of selected elastic tubes to be used in said braiding, and (b) each of said number of said plurality of selected elastic tubes to be used in said braiding to have a required diameter from amongst said range of diameters and a required wall thickness from amongst said range of wall thicknesses, and wherein said braided rope has a weight per linear foot that is in the range of 0.25-2.0 ounces per foot.

10. The method as recited in claim 9, wherein:

said range of diameters is 0.15-0.50 inches for an outer diameter.

11. The method as recited in claim 10, wherein:

said braiding is accomplished using a four-strand braid.

12. The method as recited in claim 11, wherein:

said range of wall thicknesses is 0.03-0.10 inches.

13. The method as recited in claim 11, wherein:

said braided rope has a length in the range of 6-10 feet.

14. The method as recited in claim 10, wherein:

said range of wall thicknesses is 0.03-0.10 inches.

15. The method as recited in claim 10, wherein:

said braided rope has a length in the range of 6-10 feet.

16. The method as recited in claim 9, wherein:

said braiding is accomplished using a four-strand braid.

17. The method as recited in claim 16, wherein:

said range of wall thicknesses is 0.03-0.10 inches.

18. The method as recited in claim 16, wherein:

said braided rope has a length in the range of 6-10 feet.

19. The method as recited in claim 9, wherein:

said range of wall thicknesses is 0.03-0.10 inches.

20. The method as recited in claim 9, wherein:

said braided rope has a length in the range of 6-10 feet.

* * * * *